US005492185A

United States Patent [19]

Schoeps et al.

[11] Patent Number: 5,492,185

[45] Date of Patent: Feb. 20, 1996

[54] IMPULSE WRENCH

[75] Inventors: Knut C. Schoeps, Tyresö ; Ingemar J. F. Sjörs, Bromma, both of Sweden

[73] Assignee: Atlas Copco Tools AB, Nacka, Sweden

[21] Appl. No.: 228,087

[22] Filed: Apr. 15, 1994

[30] Foreign Application Priority Data

Apr. 21, 1993 [SE] Sweden ..... 9301318

[51] Int. Cl.[6] ..... B25B 23/145

[52] U.S. Cl. ..... 173/177; 173/181; 173/183

[58] Field of Search ..... 173/176, 178, 173/180, 181, 182, 183, 177

[56] References Cited

U.S. PATENT DOCUMENTS

| | | | |
|---|---|---|---|
| 2,889,902 | 6/1959 | Harrison et al. . | |
| 3,572,447 | 3/1971 | Pauley et al. | 173/182 |
| 3,920,088 | 11/1975 | Dudek | 173/177 |
| 4,113,080 | 9/1978 | Thackston et al. | 173/177 |
| 4,163,311 | 8/1979 | Sigmund | 173/182 |
| 4,375,121 | 3/1983 | Sigmund | 173/176 |
| 4,418,764 | 12/1983 | Mizobe | 173/177 |
| 4,609,089 | 9/1986 | Kobayashi et al. | 173/183 |
| 4,648,282 | 3/1987 | Alender et al. | 173/183 |
| 5,117,919 | 6/1992 | Borries et al. | 173/177 |
| 5,181,575 | 1/1993 | Maruyama et al. | 173/180 |

FOREIGN PATENT DOCUMENTS

| | | |
|---|---|---|
| 0502748A1 | 9/1992 | European Pat. Off. . |
| 0502748A3 | 9/1992 | European Pat. Off. . |

*Primary Examiner*—Scott A. Smith

*Attorney, Agent, or Firm*—Frishauf, Holtz, Goodman, Langer & Chick

[57] ABSTRACT

An impulse wrench comprises a pneumatic rotation motor (12), a hydraulic torque impulse generator (13) provided with an impulse magnitude responsive actuator (17), a linear movement responsive electric signal producing device (25) located at the rear end of the motor (12), a movement transferring push rod (21) extending through an axial bore (22) in the motor rotor (16) and interconnecting the actuator (17) and the signal producing device (25), an electrically activated motive air shut-off valve (31) disposed concentrically with the signal producing device (25), and an external process controlling and monitoring unit (40) connected to the signal producing device (25) and the shut-off valve (31) and arranged to compute and compare received signals with predetermined values and to initiate shut-off of the power supply (31) as a desired tightening condition is reached.

16 Claims, 2 Drawing Sheets

IMPULSE WRENCH

BACKGROUND OF THE INVENTION

This invention relates to an impulse wrench of the type having a pneumatic rotation motor with a rotor, power supply means for connecting the motor to a pressure air source, a hydraulic torque impulse generator which is drivingly coupled to the forward end of the motor, and an output shaft for delivering torque impulses to screw joints to be tightened.

A problem concerned with this type of tool is the difficulty to monitor and control the tightening processes in an accurate and reliable way. The reason is that it is difficult to obtain a reliable torque impulse reflecting signal from the impulse delivering tool.

One known way of solving this problem is to use a contact free torque detecting means at the output spindle of the wrench, as described in EP 0 502 748. This known device comprises a specially designed output spindle which at least partly is made of a magnetostrictive material, and a pair of coils surrounding the spindle for detecting torque related distortion of the spindle.

This known torque impulse detecting means requires a modified impulse mechanism with a longer output spindle and an enlarged housing diameter.

As described in two German scientific studies, namely "Diplomarbeit im Fach Steurungs- und Regelungstechnik" from February 1992 and July 1992, the torque impulse detecting problem is solved by a means which does not require any modification of the impulse mechanism itself, but is easily adaptable to impulse wrench designs including impulse magnitude responsive shut-off means. Prior art impulse wrench designs suitable for this previously described technique are disclosed in for instance EP 0 441 758 and U.S. Pat. No. 4,418,764.

According to the abovementioned German studies, a torque impulse reflecting signal is obtained by an inductive displacement detecting device (LVDT=Linear Variable Differential Transformer) coupled to the coaxially extending actuating rod and being located at the rear end of the motor. The impulse wrenches used for these studies are of the type having a mechanical retardation responsive means connected to the impulse generator for obtaining a linear signal generating movement. This means that the signal obtained is an indirect reflection of the torque impulse character, since it is the retardation characteristics of the impulse generator that are actually measured. However, this signal reflects accurately enough the impulse characteristics and is used in a process monitoring and control unit to calculate tightening data of interest, like the shut-off point.

Tightening shut-off is obtained by activation of an external electromagnetic air shut-off valve.

One of the impulse wrenches used in the German studies, "Diplomarbeit" of July 1992, section 2.4.3, is of the type described in EP 0 441 758, and modified with an LVDT unit for signal generation.

A problem concerned with the previously described impulse wrenches having retardation activated means for accomplishing a linear movement is the difficulty to get an accurate operation of the mechanical elements. In particular, there is a problem to obtain an accurate movement transfer by the cam means.

Another problem is the nondistinctive power shut-off obtained by the use of an external air shut-off valve. The pressure air volume enclosed in the supply conduit downstream of the valve tends to maintain the motor rotation after the valve is closed. This may cause undesirable extra impulses and a torque overshoot. An external air shut-off valve also impairs the handling of the wrench.

SUMMARY OF THE INVENTION

The above identified problems are solved by the present invention.

In accordance with an aspect of the present invention, an impulse wrench includes a pneumatic rotation motor (12) having a forward end and a rear end, a pressure air supply (28, 29, 31) for connecting the motor (12) to a pressure air source, a hydraulic torque impulse generator (13) drivingly coupled to the forward end of the motor (12) and having an output shaft (15) for delivering torque impulses, a movement transferring push rod (21) extending axially through the motor (12) and having a forward end and a rear end, the impulse generator including an impulse magnitude responsive actuator (17) connected to the forward end of the push rod (21) for linearly moving the push rod (21), a linear movement detecting electric signal producing device (26, 27), located at the rear end of the motor (12) and connected to the rear end of the push rod (21) so as to be pushed thereby in response to movement of the push rod (21) caused by the actuator (17), for sensing the linear movement of the push rod (21) and for producing an electric signal in response thereto, corresponding to varying impulse magnitudes, the pressure air supply (28, 29, 31) including an electrically activated shut-off valve (31), the shut-off valve (31) including a tubular valve element (32) and an activation coil (34), both surrounding in a coaxial disposition the signal producing device (26, 27), and a tightening process controlling and monitoring unit (40) connected to the electric signal producing device (26, 27) and the shut-off valve (31) to cause the valve (31) to close in response to the electric signal from the electric signal producing device (26, 27) as a result of sensing of movement of the push rod (21).

BRIEF DESCRIPTION OF THE DRAWING

A preferred embodiment of the invention is described below in detail with reference to the accompanying drawings.

DESCRIPTION OF THE PREFERRED EMBODIMENTS

Figure 1:
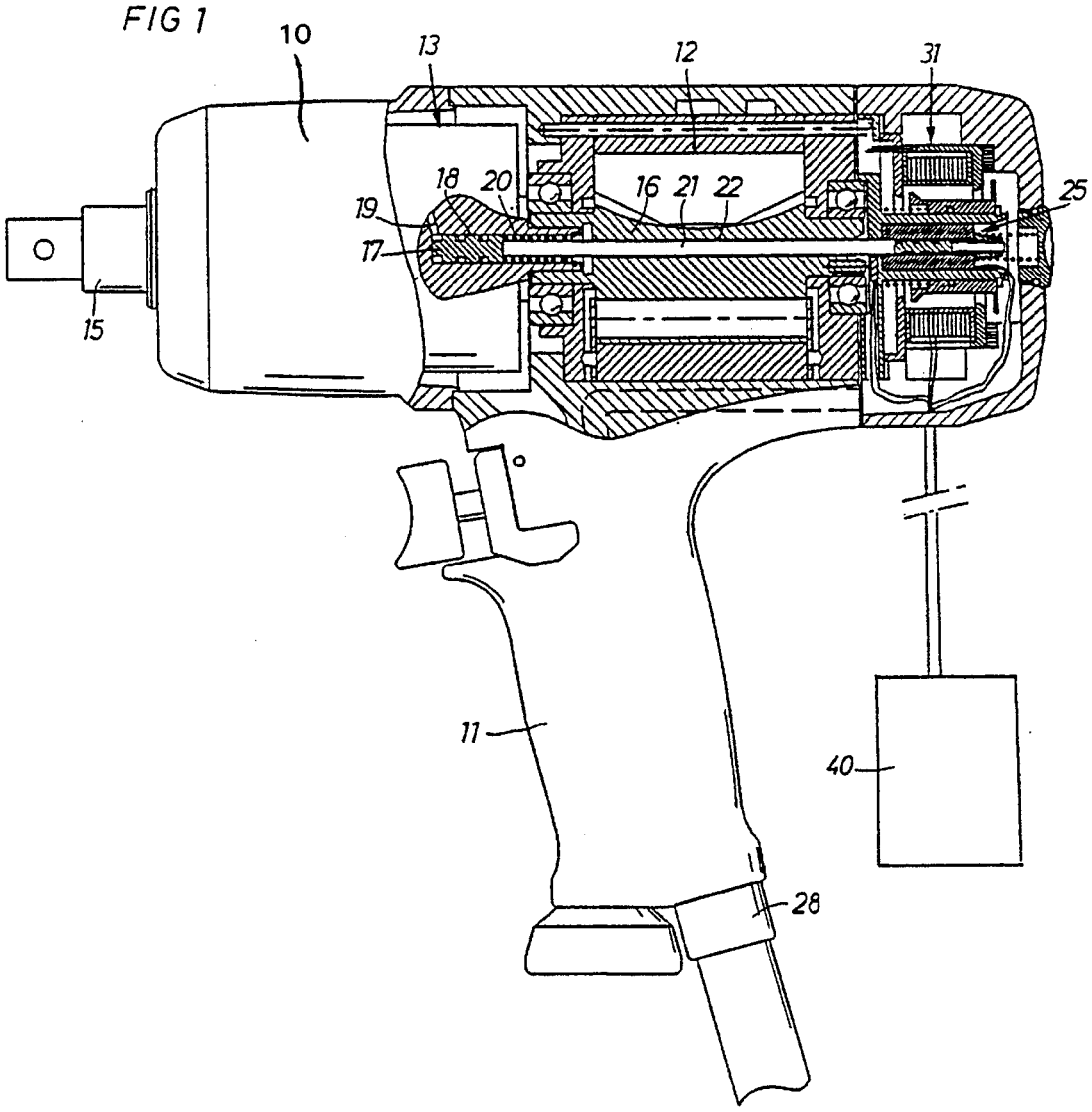
FIG. 1 shows a side view, partly in section, of an impulse wrench according to the invention.

The impulse wrench shown in FIG. 1 comprises a housing 10 with a handle 11, a pneumatic rotation motor 12 having a rotor 16, a hydraulic torque impulse generator 13 drivingly coupled to the motor 12, and an output shaft 15 for carrying a nut socket.

The wrench also includes an actuating means comprising a hydraulic piston 17 displaceably guided in a bore 18 which communicates directly with the hydraulic fluid chamber of the impulse generator 13 via a passage 19. The piston 17 is biassed by a spring 20 against the hydraulic pressure in the fluid chamber.

A push rod 21 extends through an axial bore 22 in the motor rotor 16 and is connected at its forward end to the piston 17. A spring 23 is arranged to exert a forward directed bias force on the push rod 21.

At the rear end of the motor 12, there is mounted an inductive linear displacement detecting device 25 which comprises a coil unit 26 rigidly secured in the housing 10 and a magnetic ferrite core 27 mounted at the rear end of the push rod 21. The displacement detecting device 25 is of a commercially available type of devices called LVDT (Linear Variable Differential Transformer).

The motor 12 is supplied with pressure air via a conduit connection 28 on the handle 11 and an inlet passage 29 in the housing 10. An air shut-off valve 31 is located at the rear end of the motor 12 in a coaxial disposition relative to the displacement detecting device 25. The shut-off valve 31 comprises a tubular valve element 32 guidingly supported on a tubular sleeve portion 33 in the housing 10, and an activation coil 34 surrounding the valve element 32. A spring 35 exerts a bias force on the valve element 32 and a radial flange 36 on the latter serves to interrupt the air flow by cooperation with an air inlet opening defining flange 37 in the housing 10.

The flange 36 also forms a pressurized holding surface for maintaining the valve element 32 in closed position. At the rear end of the motor rotor 16 there is also provided a rotation detecting means in the form of a magnet 38 mounted on the rotor 16 and a sensing element 39 supported in the housing 10.

The sensing element 39 as well as the coil unit 26 are connected to an external process controlling and monitoring unit 40 for delivering signals thereto, which signals reflect characteristics of the impulse tightening process. The control and monitoring unit 40 comprises a memory capacity and data computing means for treating and comparing received signals with desired target values, and means for initiating interruption of the tightening process as a desired condition is reached in the screw joint being tightened.

Figure 3:
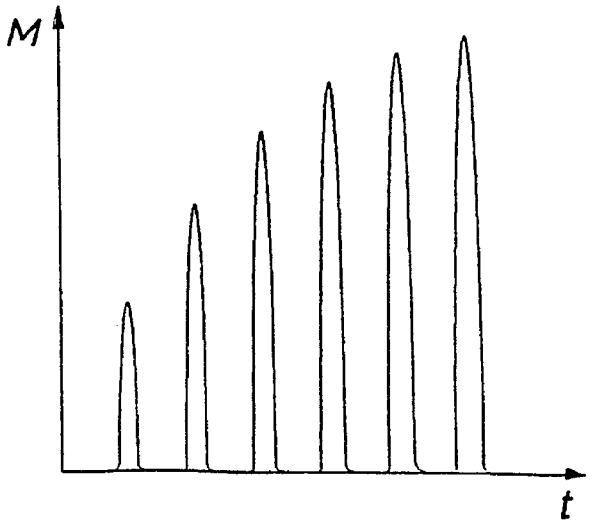
FIG. 3 shows a diagram illustrating torque/time curves of the delivered impulses.

In FIG. 3 there is illustrated the impulse reflecting signals produced by the displacement detecting device 25. The way of using these signals for calculating the desired final condition of the joint may be varied in dependence of what tightening philisophy is to be used. Tightening philosophies available are those based on torque level, yield limit, clamping force, etc.

At tightening of a screw joint by the impulse wrench described above, the tool is connected to a pressure air source via the conduit connection 28 on the handle 11, and motive air is supplied to the motor 12 via the inlet passage 29 and tile shut-off valve 31 which is maintained in open position by the spring 35.

The motor rotor 16 starts rotating the impulse generator 13 and the output shaft 15, and the screw joint connected thereto is run down. During this phase of the process no impulses are generated and no signals are delivered from the displacement detecting device 25. A signal is produced by the rotation detecting element 39, though, which indicates the speed and direction of the rotation.

At increasing resistance from the screw joint, the impulse generator starts delivering torque impulses, and for each impulse, the hydraulic pressure in the impulse generator reaches a peak level during a short time interval. This means that the piston 17 is moved to the right in FIG. 1, against the action of the spring 20, displacing at the same time the push rod 21 and the ferrite core 27 of the LVDT unit 25 against the action of the spring 23.

During the reciprocation of the push rod 21 at repeated impulses, the ferrite core 27 is displaced relative to the coil unit 26 and an electric signal is produced. Since the hydraulic pressure within the impulse generator corresponds to the magnitude of the delivered impulses, the force acting on the piston 17 is directly responsive to the actual impulse magnitude. This also means that the axial displacement of the push rod 21 and ferrite core 27 corresponds to the impulse magnitude.

Figure 2:
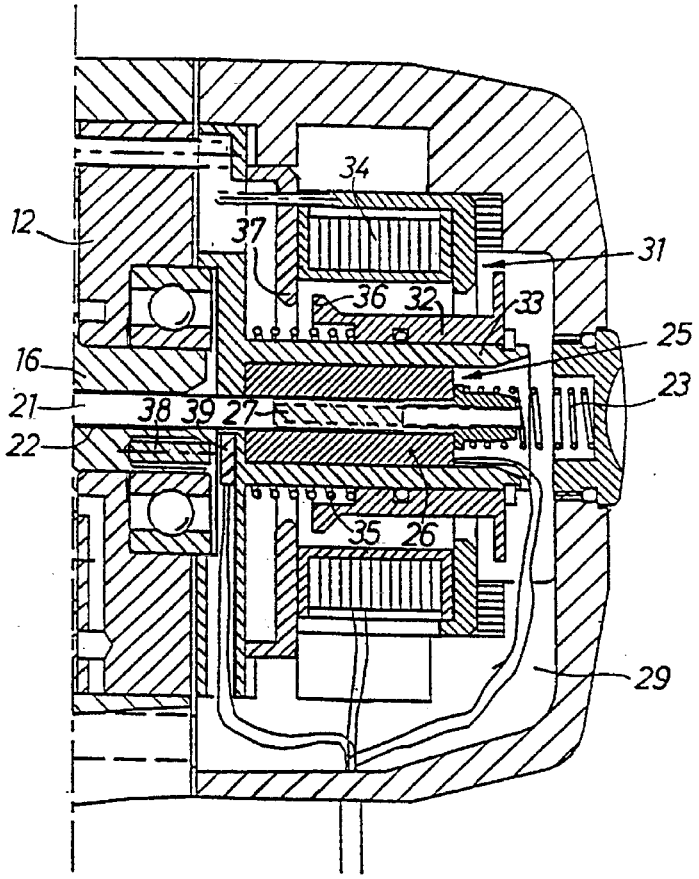
FIG. 2 shows, on a larger scale, a fractional section through the rear end of the wrench in FIG. 1.

By computing the received signals and comparing the result with preset target values, the control and monitoring unit 40 establishes when the desired tightening condition is reached. Thereat, a signal is sent to the shut-off valve 31 making the valve element 32 shift to the left in FIGS. 1 and 2 and to occupy its closed position. Now, the motor 12 stops and the tightening process is completed.

We claim:

1. Impulse wrench, comprising:

a pneumatic rotation motor (12) having a forward end and a rear end, pressure air supply means (28, 29, 31) for connecting said motor (12) to a pressure air source, a hydraulic torque impulse generator (13) drivingly coupled to the forward end of said motor (12) and having an output shaft (15) for delivering torque impulses, a movement transferring push rod (21) extending axially through said motor (12) and having a forward end and a rear end, said impulse generator including an impulse magnitude responsive actuating means (17) connected to the forward end of said push rod (21) for linearly moving said push rod (21), linear movement detecting electric signal producing means (26, 27), located at the rear end of said motor (12) and connected to the rear end of said push rod (21) so as to be pushed by said push rod (21) in response to movement of said push rod (21) caused by said actuating means (17), for sensing said linear movement of said push rod (21) and for producing an electric signal in response thereto, corresponding to varying impulse magnitudes, said pressure air supply means (28, 29, 31) including an electrically activated shut-off valve (31), and a tightening process controlling and monitoring unit (40) connected to said electric signal producing means (26, 27) and to said shut-off valve (31) to cause said shut-off valve (31) to close in response to said electric signal from said electric signal producing means (26, 27) as a result of sensing of movement of said push rod (21).

2. Impulse wrench according to claim 1, wherein:

said impulse generator (13) includes a hydraulic fluid chamber having a fluid at an actual hydraulic pressure of operation of said impulse wrench, which reflects an actual impulse magnitude of said impulse wrench, and said actuating means comprises a piston (17) displaceably guided in a bore (18) which communicates with the hydraulic fluid chamber of the impulse generator (13), said piston (17) being arranged to displace said push rod (21) in response to the actual hydraulic pressure which reflects the actual impulse magnitude.

3. Impulse wrench according to claim 2, wherein said signal producing means (26, 27) comprises an inductive linear displacement detector.

4. Impulse wrench according to claim 3, wherein said shut-off valve (31) comprises a tubular valve element (32)

and an activation coil (34), both surrounding in a coaxial disposition said signal producing means (26, 27).

5. Impulse wrench according to claim 4, wherein:

said motor includes a rotor (16); and a rotation detecting electric signal producing means (38, 39) is associated with said rotor (16) and connected to said process controlling and monitoring unit (40), for detecting rotation of said rotor (16).

6. Impulse wrench according to claim 3, wherein:

said motor includes a rotor (16); and a rotation detecting electric signal producing means (38, 39) is associated with said rotor (16) and connected to said process controlling and monitoring unit (40), for detecting rotation of said rotor (16).

7. Impulse wrench according to claim 2, wherein:

said motor includes a rotor (16); and a rotation detecting electric signal producing means (38, 39) is associated with said rotor (16) and connected to said process controlling and monitoring unit (40), for detecting rotation of said rotor (16).

8. Impulse wrench according to claim 1, wherein said signal producing means (26, 27) comprises an inductive linear displacement detector.

9. Impulse wrench according to claim 8, wherein said shut-off valve (31) comprises a tubular valve element (32) and an activation coil (34), both surrounding in a coaxial disposition said signal producing means (26, 27).

10. Impulse wrench according to claim 9, wherein:

said motor includes a rotor (16); and a rotation detecting electric signal producing means (38, 39) is associated with said rotor (16) and connected to said process controlling and monitoring unit (40), for detecting rotation of said rotor (16).

11. Impulse wrench according to claim 8, wherein:

said motor includes a rotor (16); and a rotation detecting electric signal producing means (38, 39) is associated with said rotor (16) and connected to said process controlling and monitoring unit (40), for detecting rotation of said motor (16).

12. Impulse wrench according to claim 2, wherein said shut-off valve (31) comprises a tubular valve element (32) and an activation coil (34), both surrounding in a coaxial disposition said signal producing means (26, 27).

13. Impulse wrench according to claim 12, wherein:

said motor includes a rotor (16); and a rotation detecting electric signal producing means (38, 39) is associated with said rotor (16) and connected to said process controlling and monitoring unit (40), for detecting rotation of said rotor (16).

14. Impulse wrench according to claim 1, wherein:

said motor includes a rotor (16); and a rotation detecting electric signal producing means (38, 39) is associated with said rotor (16) and connected to said process controlling and monitoring unit (40), for detecting rotation of said rotor (16).

15. Impulse wrench, comprising:

a pneumatic rotation motor (12) having a forward end and a rear end, a pressure air supply means (28, 29, 31) for connecting said motor (12) to a pressure air source, a hydraulic torque impulse generator (13) drivingly coupled to the forward end of said motor (12) and having an output shaft (15) for delivering torque impulses, a movement transferring push rod (21) extending axially through said motor (12) and having a forward end and a rear end, said impulse generator including an impulse magnitude responsive actuating means (17) connected to the forward end of said push rod (21) for linearly moving said push rod (21), linear movement detecting electric signal producing means (26, 27), located at the rear end of said motor (12) and connected to the rear end of said push rod (21) so as to be pushed thereby in response to movement of said push rod (21) caused by said actuating means (17), for sensing said linear movement of said push rod (21) and for producing an electric signal in response thereto, corresponding to varying impulse magnitudes, said pressure air supply means (28, 29, 31) including an electrically activated shut-off valve (31), said shut-off valve (31) including a tubular valve element (32) and an activation coil (34), both surrounding in a coaxial disposition said signal producing means (26, 27), and a tightening process controlling and monitoring unit (40) connected to said electric signal producing means (26, 27) and said shut-off valve (31) to cause said valve (31) to close in response to said electric signal from said electric signal producing means (26, 27) as a result of sensing of movement of said push rod (21).

16. Impulse wrench according to claim 15, wherein:

said motor includes a rotor (16); and a rotation detecting electric signal producing means (38, 39) is associated with said rotor (16) and connected to said process controlling and monitoring unit (40), for detecting rotation of said rotor (16).

* * * * *